US008337151B2

(12) United States Patent
Cooper et al.

(10) Patent No.: US 8,337,151 B2
(45) Date of Patent: Dec. 25, 2012

(54) SYSTEM AND METHOD FOR ALIGNING TURBINE COMPONENTS

(75) Inventors: Edward J. Cooper, Niskayuna, NY (US); Timothy Andrew Melsert, Ballston Lake, NY (US); James W. Clark, Schenectady, NY (US); Craig D. Ivancic, Gloversville, NY (US); Sean O'Meara, Bradenton, FL (US); Jean-francois Lavie, Belfort (FR)

(73) Assignee: General Electric Company, Schenectady, NY (US)

( * ) Notice: Subject to any disclaimer, the term of this patent is extended or adjusted under 35 U.S.C. 154(b) by 741 days.

(21) Appl. No.: 12/495,745

(22) Filed: Jun. 30, 2009

(65) Prior Publication Data

US 2010/0329837 A1 Dec. 30, 2010

(51) Int. Cl.

| | |
|---|---|
| ***F01D 25/24*** | (2006.01) |
| ***F01D 25/26*** | (2006.01) |
| ***F03B 11/02*** | (2006.01) |
| ***F03B 11/00*** | (2006.01) |
| ***F04D 29/40*** | (2006.01) |

(52) U.S. Cl. ..... 415/126; 415/213.1; 415/214.1

(58) Field of Classification Search ..... 415/213.1, 415/214.1, 126, 128; 416/244 R, 246; 248/674, 248/188.1, 188.2

See application file for complete search history.

(56) References Cited

U.S. PATENT DOCUMENTS

| | | | | |
|---|---|---|---|---|
| 4,732,533 | A * | 3/1988 | Remberg et al. | 415/134 |
| 4,744,726 | A * | 5/1988 | Remberg | 415/199.4 |
| 5,063,661 | A * | 11/1991 | Lindsay | 29/888.02 |
| 5,072,993 | A | 12/1991 | Dickerson | |
| 5,346,360 | A | 9/1994 | Cooper | |
| 5,640,813 | A | 6/1997 | Glazik et al. | |
| 6,406,256 | B1 | 6/2002 | Marx | |
| 6,560,934 | B1 * | 5/2003 | Workman | 52/126.1 |
| 6,799,766 | B2 * | 10/2004 | Crudgington et al. | 277/355 |
| 6,988,869 | B2 | 1/2006 | Haje | |
| 7,025,559 | B2 | 4/2006 | Loy et al. | |
| 2007/0189893 | A1 * | 8/2007 | Burdgick | 415/213.1 |
| 2008/0240902 | A1 | 10/2008 | Cooper | |
| 2008/0286097 | A1 * | 11/2008 | Chevrette et al. | 415/209.2 |
| 2009/0014621 | A1 * | 1/2009 | Baten | 248/674 |

* cited by examiner

*Primary Examiner* — Edward Look
*Assistant Examiner* — Su Htay
(74) *Attorney, Agent, or Firm* — Fletcher Yoder, P.C.

(57) ABSTRACT

Embodiments include a system having a turbine support key having a set of key segments selectively stackable together in a plurality of combinations to adjust a thickness between turbine supports based solely on a selection of the key segments from the set.

21 Claims, 9 Drawing Sheets

SYSTEM AND METHOD FOR ALIGNING TURBINE COMPONENTS

BACKGROUND OF THE INVENTION

The subject matter disclosed herein relates to turbine engines and, more specifically, to assembly, support, and alignment of components of the turbine engines.

In certain applications, steam turbines may include various sections designed to be assembled during installation. Each steam turbine may be covered by a turbine shell and may be separated from other turbines by a "standard" (also referred to as a "pedestal) to provide a housing for supporting components. The turbine shells may include arms or other extensions that may be supported by the standard, such as through a vertical support on the standard itself.

The turbine shell generally covers and protects the rotary components of the turbine. During installation, the turbine shell is generally aligned with rotary components to avoid interference with the components. The vertical supports on the standard may include extra stock on its thickness to support the turbine shell. To install and properly align the turbine shell, the extra stock on the supports may be machined (e.g., grinded) down in the field to achieve the desired alignment of the turbine shell and rotary component. However, the machining operation may delay initial startup of the steam turbine depending on the availability of the shop. Further, some plants or install sites may not have any access to a machine shop to perform the machining of the vertical support.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine engine and a support assembly configured to support the turbine engine. The support assembly comprises a first support and a second support. The system further includes a key pack configured to mount between the first and second supports, wherein the key pack includes a plurality of key segments selectively arranged one over another to define a thickness.

In a second embodiment, a system includes a turbine support key, comprising a set of key segments selectively stackable together in a plurality of combinations to adjust a thickness between turbine supports based solely on a selection of the key segments from the set.

In a third embodiment, a method includes defining a thickness solely by selectively stacking two or more key segments from a key pack into a key stack and aligning a turbine shell with internal rotary components via placement of the key stack between first and second supports.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Embodiments of the present invention include a key pack having selectively addable or removable segments for aligning turbine components, e.g., turbine shells, of a steam turbine. The key pack may include a plurality of plates of equal or different thicknesses. The key pack is designed to enable alignment of the turbine components without machining. For example, one or more segments (e.g., plates) may be used as needed to define an appropriate thickness for alignment, while the extra segments are not used. In one embodiment, the key pack may include a main key and segments that may be selectively stacked (e.g., added or removed) to define a thickness on a support block of a standard. The support block may support an arm of an upper half turbine shell, such that the thickness generally aligns the turbine shell with the internal rotary components of the turbine. The main key may include a slot configured to engage a lockable plate on the support block to secure the key pack. As appreciated, the key pack enables quick and easy alignment of turbine components in the field without the need for machining.

Figure 1:
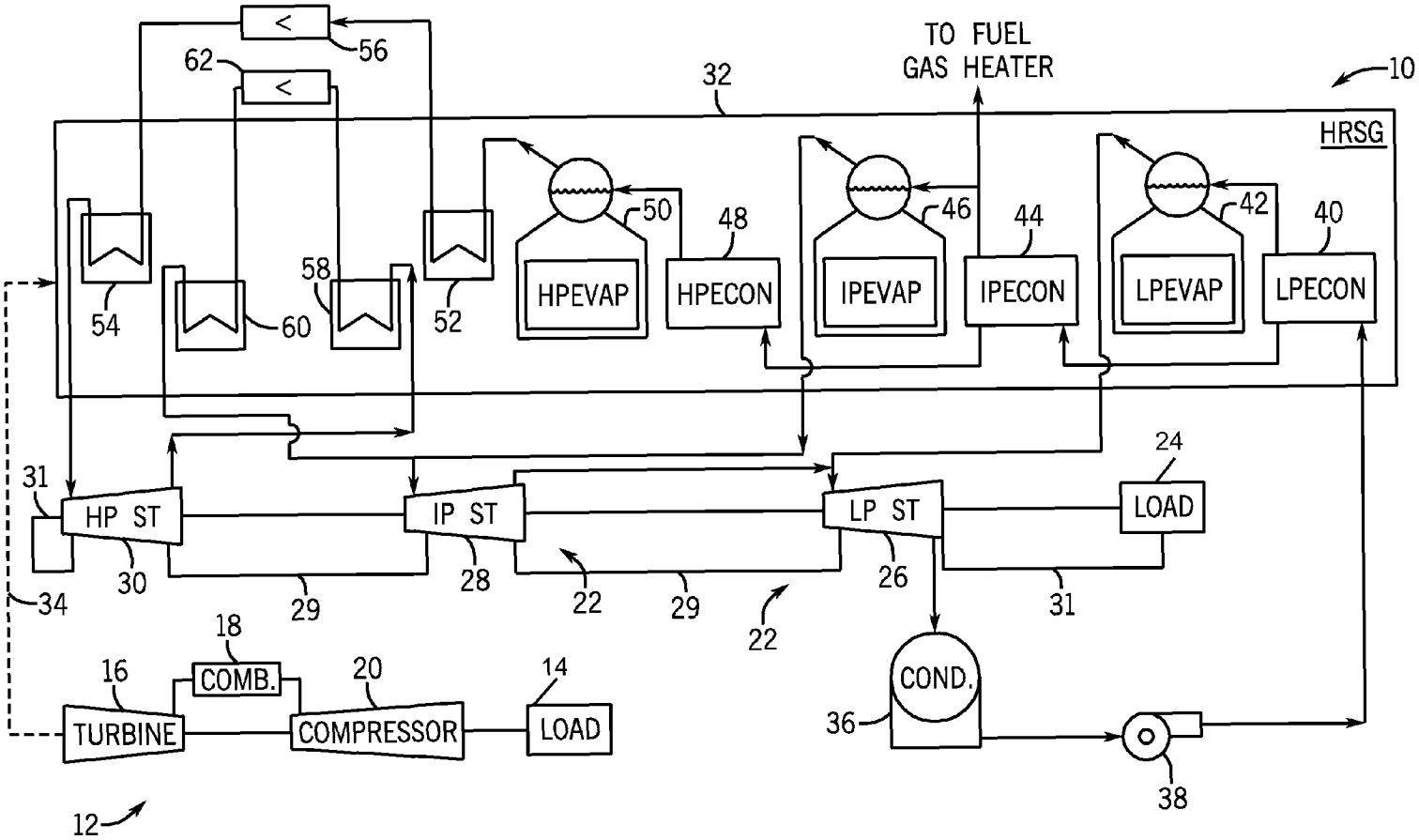
FIG. 1 is a schematic flow diagram of an embodiment of a combined cycle power generation system having a gas turbine, a steam turbine, and a heat recovery steam generation (HRSG) system.

FIG. 1 is a schematic flow diagram of an embodiment of a combined cycle power generation system 10 having a gas turbine 12, a steam turbine 22, and a heat recovery steam generation (HRSG) system 32. System 10 may employ one or more key packs to align various components in the gas turbine 12, the steam turbine 22, and/or the HRSG 12. Each installed key pack may include one or more key segments (e.g., plates) selected from a plurality of segments in an installation kit having the uninstalled key pack. During setup, some but not necessarily all of the key segments may be used to align components at a suitable dimension defined by thickness of the key segments.

The system 10 may include the gas turbine 12 for driving a first load 14. The first load 14 may, for instance, be an electrical generator for producing electrical power. The gas turbine 12 may include a turbine 16, a combustor or combustion chamber 18, and a compressor 20. The system 10 may also include the steam turbine 22 for driving a second load 24. The second load 24 may also be an electrical generator for generating electrical power. However, both the first and second loads 14, 24 may be other types of loads capable of being driven by the gas turbine 12 and steam turbine 22. In addition, although the gas turbine 12 and steam turbine 22 may drive separate loads 14 and 24, as shown in the illustrated embodiment, the gas turbine 12 and steam turbine 22 may also be utilized in tandem to drive a single load via a single shaft. In the illustrated embodiment, the steam turbine 22 may include one low-pressure section 26 (LP ST), one intermediate-pressure section 28 (IP ST), and one high-pressure section 30 (HP ST). However, the specific configuration of the steam turbine 22, as well as the gas turbine 12, may be implementation-specific and may include any combination of sections.

Each section of the steam turbine 22, e.g., the low pressure section 26, the intermediate pressure section 28, and the high-pressure section 30, may be generally supported and separated by mid standards 29 (e.g., pedestals or support assemblies). Similarly, end standards 31 (e.g., pedestals or support assemblies) may be generally support the ends of the high pressure section 30 and the low pressure section 26. The standards 29 and 31 may be disposed along the axis of the turbine 22, and may include various components such as supports, pickups, and piping between the turbine sections 26, 28, and 30. As described in detail below, the standards 29 and 31 (e.g., pedestals or support assemblies) may also provide for alignment of the turbine shells of the sections 26, 28, and 30, though selection of segments in a key pack 84.

The system 10 may also include the multi-stage HRSG 32. The components of the HRSG 32 in the illustrated embodiment are a simplified depiction of the HRSG 32 and are not intended to be limiting. Rather, the illustrated HRSG 32 is shown to convey the general operation of such HRSG systems. Heated exhaust gas 34 from the gas turbine 12 may be transported into the HRSG 32 and used to heat steam used to power the steam turbine 22. Exhaust from the low-pressure section 26 of the steam turbine 22 may be directed into a condenser 36. Condensate from the condenser 36 may, in turn, be directed into a low-pressure section of the HRSG 32 with the aid of a condensate pump 38.

The condensate may then flow through a low-pressure economizer 40 (LPECON), a device configured to heat feedwater with gases, which may be used to heat the condensate. From the low-pressure economizer 40, a portion of the condensate may be directed into a low-pressure evaporator 42 (LPEVAP) while the rest may be pumped toward an intermediate-pressure economizer 44 (IPECON). Steam from the low-pressure evaporator 42 may be returned to the low-pressure section 26 of the steam turbine 22. Likewise, from the intermediate-pressure economizer 44, a portion of the condensate may be directed into an intermediate-pressure evaporator 46 (IPEVAP) while the rest may be pumped toward a high-pressure economizer 48 (HPECON). Steam from the intermediate-pressure evaporator 46 may be sent to the intermediate-pressure section 28 of the steam turbine 22. Again, the connections between the economizers, evaporators, and the steam turbine 22 may vary across implementations as the illustrated embodiment is merely illustrative of the general operation of an HRSG system that may employ unique aspects of the present embodiments.

Finally, condensate from the high-pressure economizer 48 may be directed into a high-pressure evaporator 50 (HPEVAP). Steam exiting the high-pressure evaporator 50 may be directed into a primary high-pressure superheater 52 and a finishing high-pressure superheater 54, where the steam is superheated and eventually sent to the high-pressure section 30 of the steam turbine 22. Exhaust from the high-pressure section 30 of the steam turbine 22 may, in turn, be directed into the intermediate-pressure section 28 of the steam turbine 22. Exhaust from the intermediate-pressure section 28 of the steam turbine 22 may be directed into the low-pressure section 26 of the steam turbine 22.

An inter-stage attemperator 56 may be located in between the primary high-pressure superheater 52 and the finishing high-pressure superheater 54. The inter-stage attemperator 56 may allow for more robust control of the exhaust temperature of steam from the finishing high-pressure superheater 54. Specifically, the inter-stage attemperator 56 may be configured to control the temperature of steam exiting the finishing high-pressure superheater 54 by injecting cooler feedwater spray into the superheated steam upstream of the finishing high-pressure superheater 54 whenever the exhaust temperature of the steam exiting the finishing high-pressure superheater 54 exceeds a predetermined value.

In addition, exhaust from the high-pressure section 30 of the steam turbine 22 may be directed into a primary re-heater 58 and a secondary re-heater 60 where it may be re-heated before being directed into the intermediate-pressure section 28 of the steam turbine 22. The primary re-heater 58 and secondary re-heater 60 may also be associated with an inter-stage attemperator 62 for controlling the exhaust steam temperature from the re-heaters. Specifically, the inter-stage attemperator 62 may be configured to control the temperature of steam exiting the secondary re-heater 60 by injecting cooler feedwater spray into the superheated steam upstream of the secondary re-heater 60 whenever the exhaust temperature of the steam exiting the secondary re-heater 60 exceeds a predetermined value.

In combined cycle systems such as system 10, hot exhaust gas 34 may flow from the gas turbine 12 and pass through the HRSG 32 and may be used to generate high-pressure, high-temperature steam. The steam produced by the HRSG 32 may then be passed through the steam turbine 22 for power generation. In addition, the produced steam may also be supplied to any other processes where superheated steam may be used. The gas turbine 12 cycle is often referred to as the "topping cycle," whereas the steam turbine 22 generation cycle is often referred to as the "bottoming cycle." By combining these two cycles as illustrated in FIG. 1, the combined cycle power generation system 10 may lead to greater efficiencies in both cycles. In particular, exhaust heat from the topping cycle may be captured and used to generate steam for use in the bottoming cycle.

Figure 2:
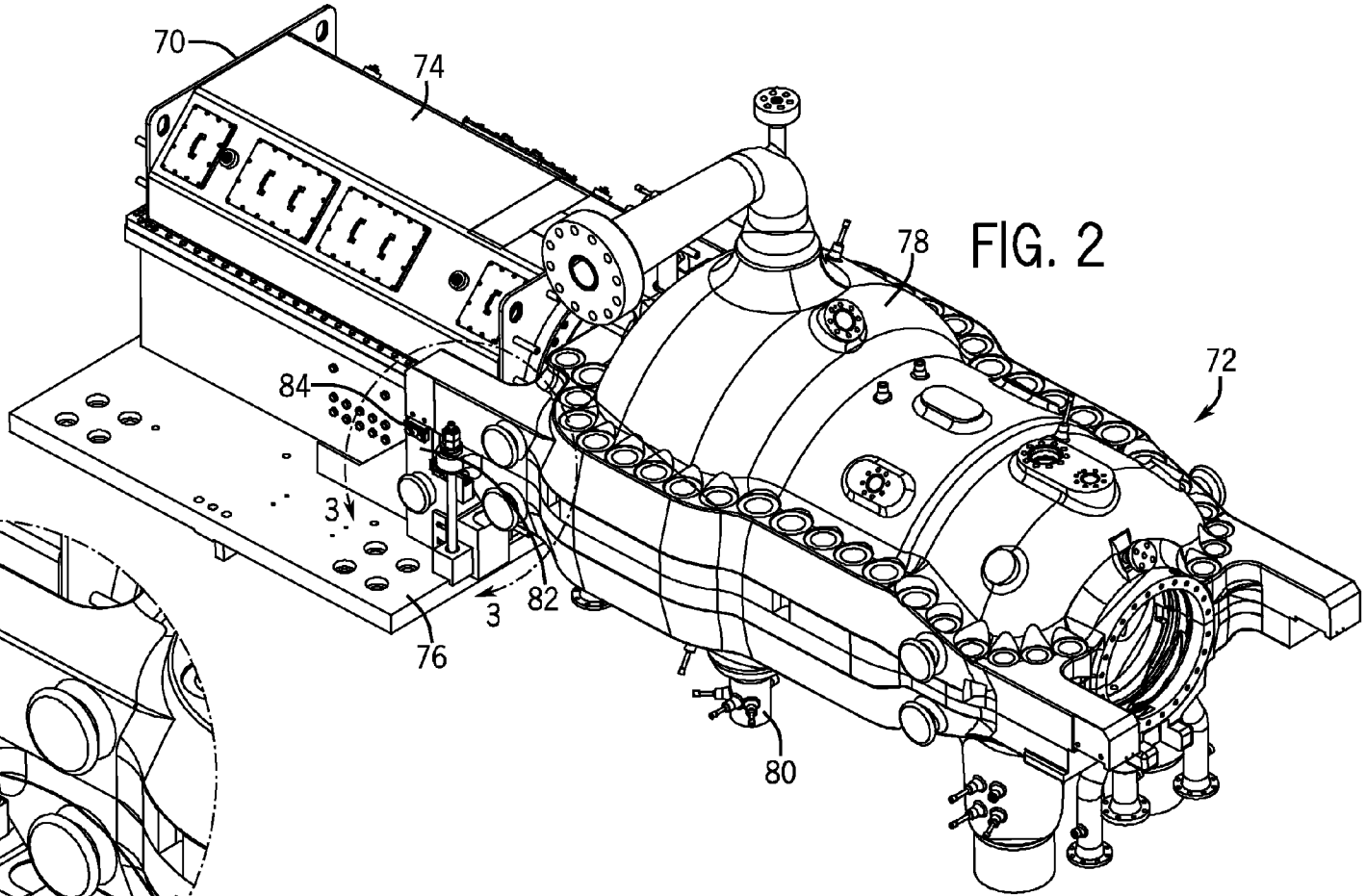
FIG. 2 is a perspective view of a turbine standard and a turbine shell in accordance with an embodiment of the present invention.

FIG. 2 is a perspective view of a turbine pedestal, support assembly or standard 70, e.g., a mid standard 29 or end standard 31, supporting a turbine shell 72, e.g., a shell of the low pressure section 26, the intermediate pressure section 28, and the high-pressure section 30. The standard 70 (e.g., pedestal or support assembly) may include an upper half 74 (e.g., support) and a lower half 76 (e.g., support), and the turbine shell 72 may include an upper half turbine shell 78 or a lower half turbine shell 80. The upper half turbine shell 78 may be generally supported and aligned by shell arm support block 82 (e.g., first support) of the standard 70 (e.g., support assembly). As described in detail below, a key pack 84 (also referred to as a "turbine support key" or a "key and shim assembly") may be disposed on the support block 82 to provide for adjustment of the height of the support block 82 and alignment of the upper half turbine shell 78. As will be appreciated, the alignment of the upper half turbine shell 78 also aligns the lower half turbine shell 80, as the two shell halves 78 and 80 are bolted together along their common joint surfaces. The key pack 84 may include one or more key segments (e.g., plates or shims) selectively stacked to define a suitable thickness for alignment. As appreciated, the key pack 84 may include key segments of equal and/or different heights, such that the suitable thickness can be achieved without any machining, thereby substantially simplifying the installation process.

Figure 3:
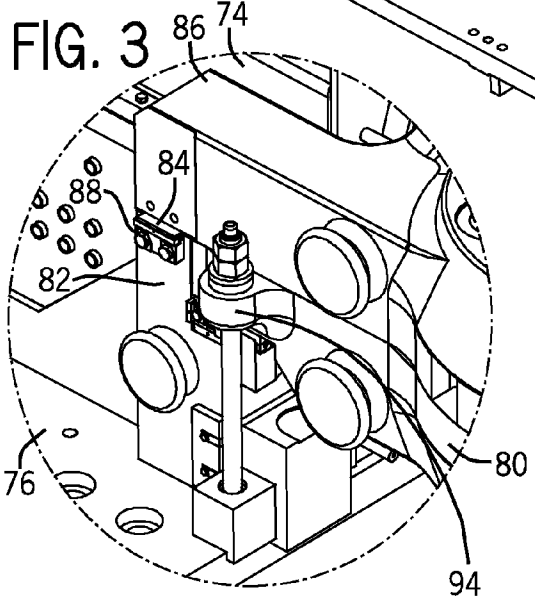
FIG. 3 is a close-up view of region 3-3 of FIG. 2 depicting a support and key pack in accordance with an embodiment of the present invention.

FIG. 3 is a close-up perspective view of region 3-3 of FIG. 2, depicting the support block 82 (e.g., first support of support assembly 70) and key pack 84 in accordance with an embodiment of the present invention. As shown in FIG. 3, the upper half turbine shell 78 may include arms 86 (e.g., second support of support assembly 70) extending parallel to the axis of the turbine shell 72 and supported on the support block 82 (e.g., first support) via the key pack 84. The support block 82 may include a lower lock plate 88 that may secure and lock the key pack 84 to the support block 82.

Figure 4:
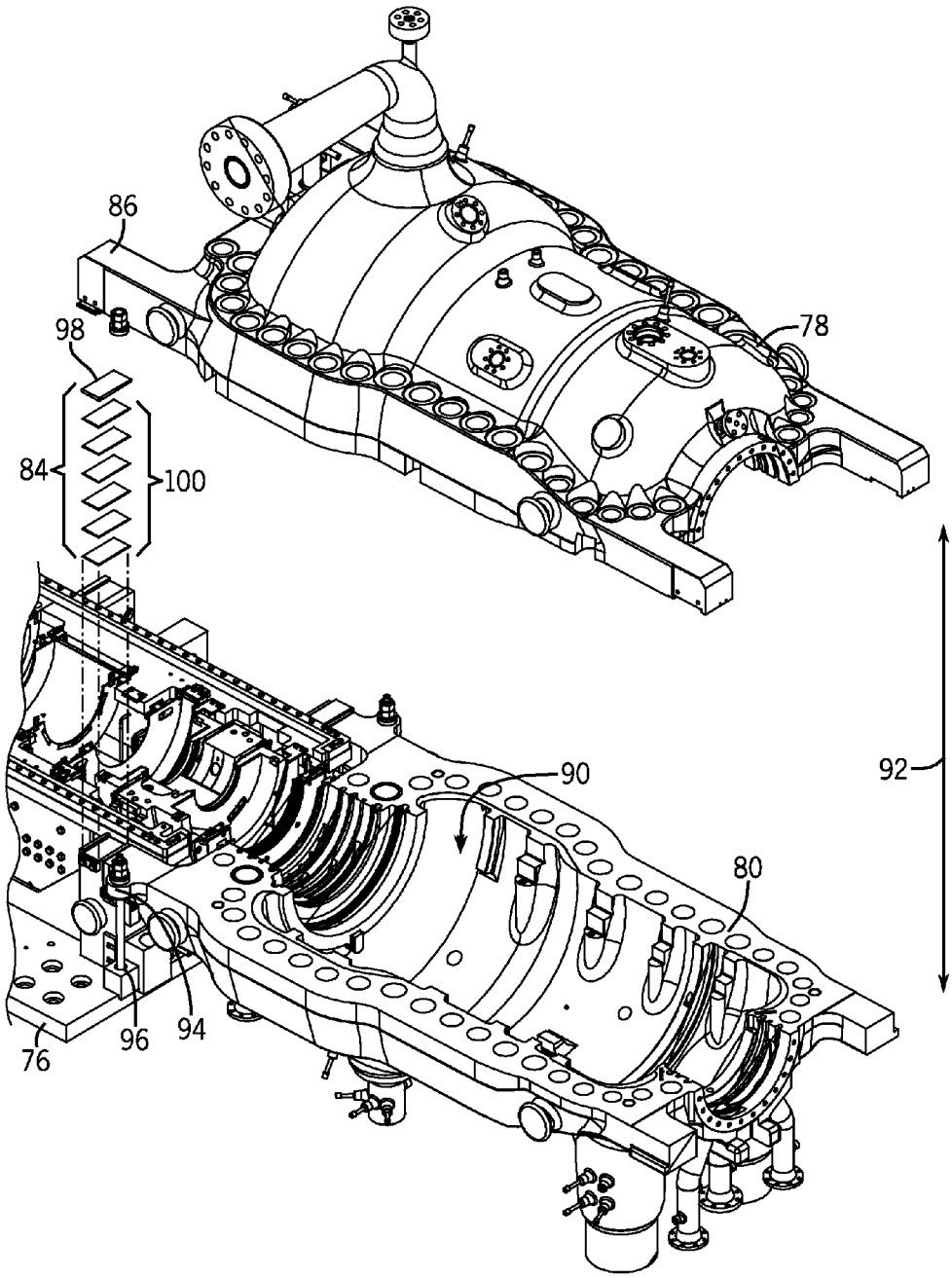
FIG. 4 is an exploded perspective view of the turbine shell of FIG. 2 and a key pack in accordance with an embodiment of the present invention.

FIG. 4 depicts an exploded perspective view of the upper half turbine shell 78, the lower half turbine shell 80, and the key pack 84 in accordance with an embodiment of the present invention. When assembled, rotary components (e.g., shaft, wheels, turbine blades, etc.) of the turbine 22 may be disposed in an internal cavity 90 generally defined by the upper half turbine shell 78 and the lower half turbine shell 80 of the turbine 72. This cavity 90 supports other stationary turbine components, e.g., diaphragms, seals and steam packing, which typically have close radial clearances with rotary components. Thus, to provide the desired radial running clearance for the rotary components, the upper half turbine shell 78 and the lower half turbine shell 80, which are bolted together, may be aligned relative to the turbine rotary components along the vertical axis indicated by arrow 92. As seen in FIGS. 3 and 4, the lower half turbine shell 80 may include cast shell extensions 94 along the joint close to the support 82. These extensions 94 may be secured to the standard 70 (e.g., support assembly) via a pin and bolt assembly 96 or any suitable fasteners, to prevent vertical lifting of the upper shell arm relative to support block 82 (e.g., first support) during turbine operation.

As illustrated in FIG. 4, the key pack 84 is exploded into a plurality of segments. The key pack 84 may include a main key segment 98 (e.g., a main key) and one or more segments 100 (e.g., shims). As explained further below, one or more segments 100 may be selectively added to or removed from the key pack 84 to adjust the height of the support block 82 (e.g., first support) and alignment of the upper half turbine shell 78 and lower half shell 80 relative to the turbine rotary components. These key segments 98 and 100 may have equal or different thickness from one another. In certain embodiments, the key pack 84 may include at least greater than approximately 5, 10, 15, 20, 25, 30, 35, 40, 45, 50, or more segments for selective use during assembly. The key pack 84 may include segments that increase in thickness by at least approximately 5, 10, 15, 20, 25, 30, 35, 40, 45, 50, or more percent.

Figure 5:
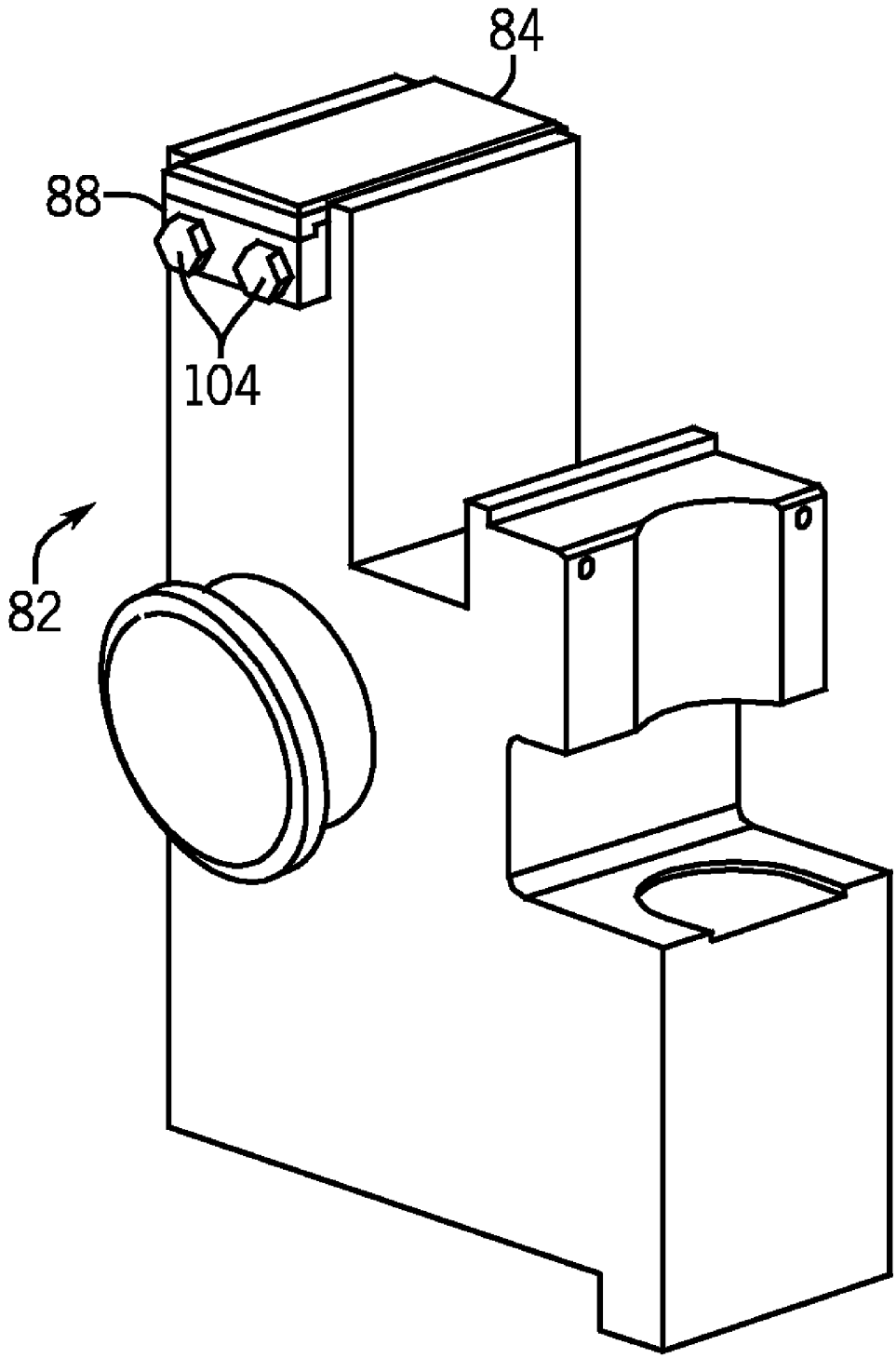
FIG. 5 is a close-up perspective view of a support block and a key pack of FIGS. 2-4 in accordance with an embodiment of the present invention.
Figure 6:
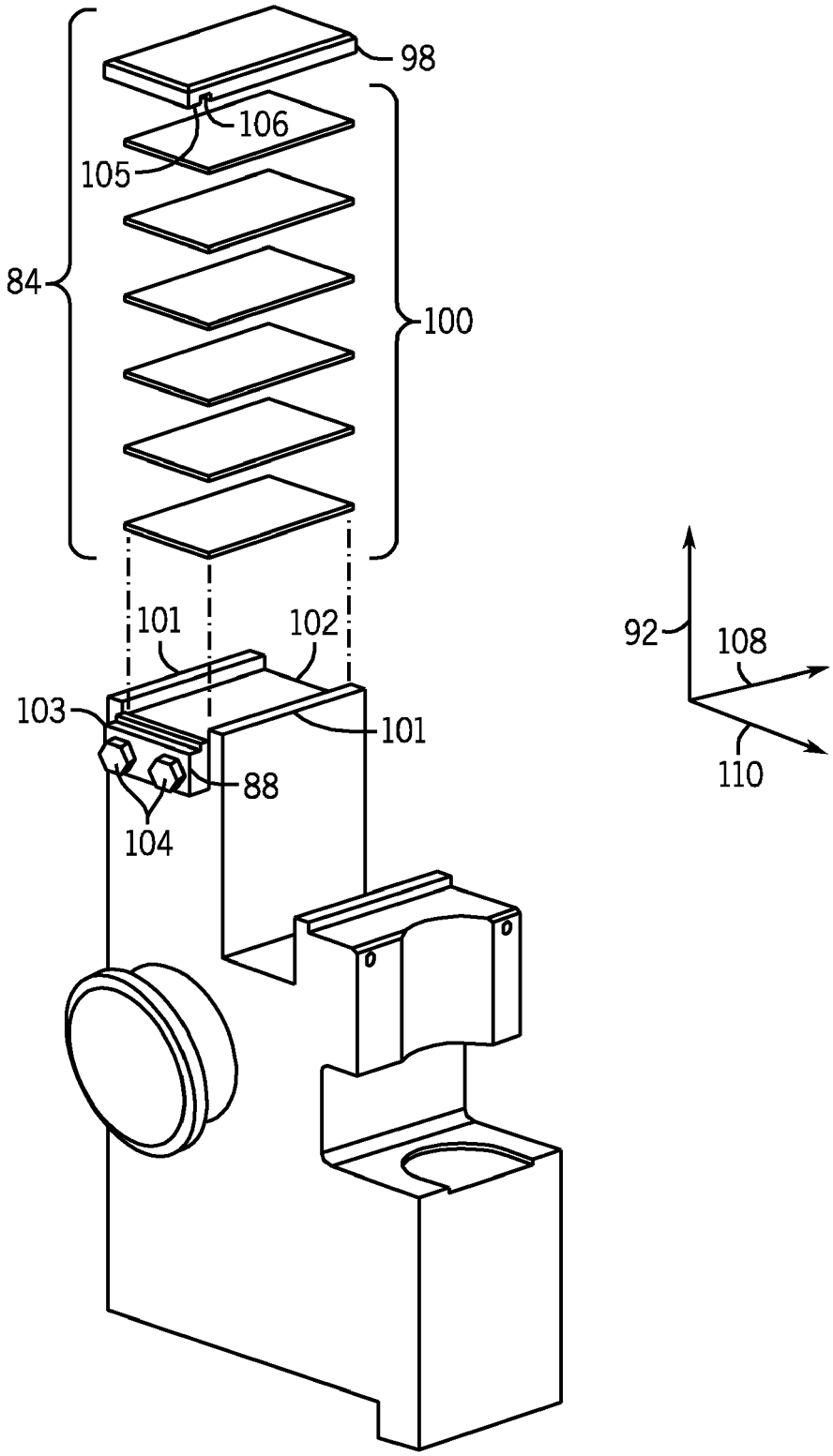
FIG. 6 is a close-up exploded perspective view of the support block and the key pack of FIG. 5 in accordance with an embodiment of the present invention.

FIG. 5 depicts a close up perspective view of the support block 82 (e.g., first support) with the key pack 84 installed in accordance with an embodiment of the present invention. Similarly, FIG. 6 depicts the close-up perspective view of FIG. 5 with segments of the key pack 84 exploded from one another in accordance with an embodiment of the present invention. As seen in FIGS. 5 and 6, the key pack 84 may be retained by side tabs, bars, or protrusions 101 surrounding a recess 102 of the support block 82. The recess 102 may have a shape and dimensions generally similarly to the segments 100 and main key 98 to retain the key pack 84.

As mentioned above, the support block 82 (e.g., first support of support assembly 70) may also include a lower lock plate 88 that engages the main key 98 to secure the key pack 84. The lower lock plate 88 may be secured to the support block 82 by one or more bolts 104 or any suitable fasteners. The lower lock plate 88 may include a protrusion 103 and/or recessed edge 104 configured to engage a protrusion 105 and/or recess 106 of the main key 98. Thus, when assembled into the recess 102 of the support block 82, the key pack 84 may be retained from moving in the direction indicated by arrow 108 by the lower lock plate 88 and direction indicated by arrow 110 by the recess 102. The weight of the arm 86 (e.g., second support of support assembly 70) may provide sufficient force on the key pack 84 to aid in blocking movement in the directions indicated by arrow 92, arrow 108 and arrow 110.

Figure 7:
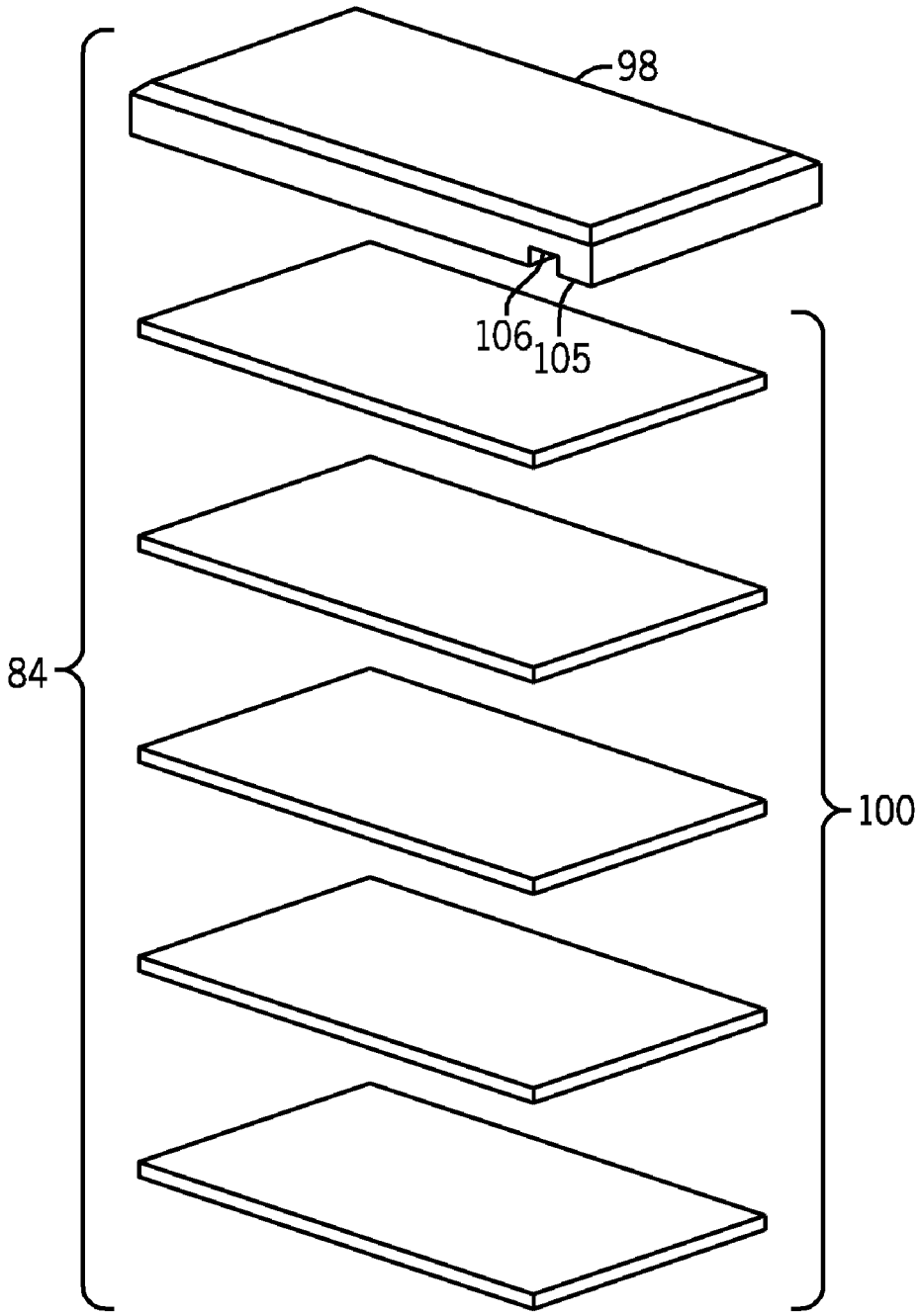
FIGS. 7 and 8 depict close-up exploded views of the key pack of FIGS. 2-6 in accordance with an embodiment of the present invention.
Figure 8:
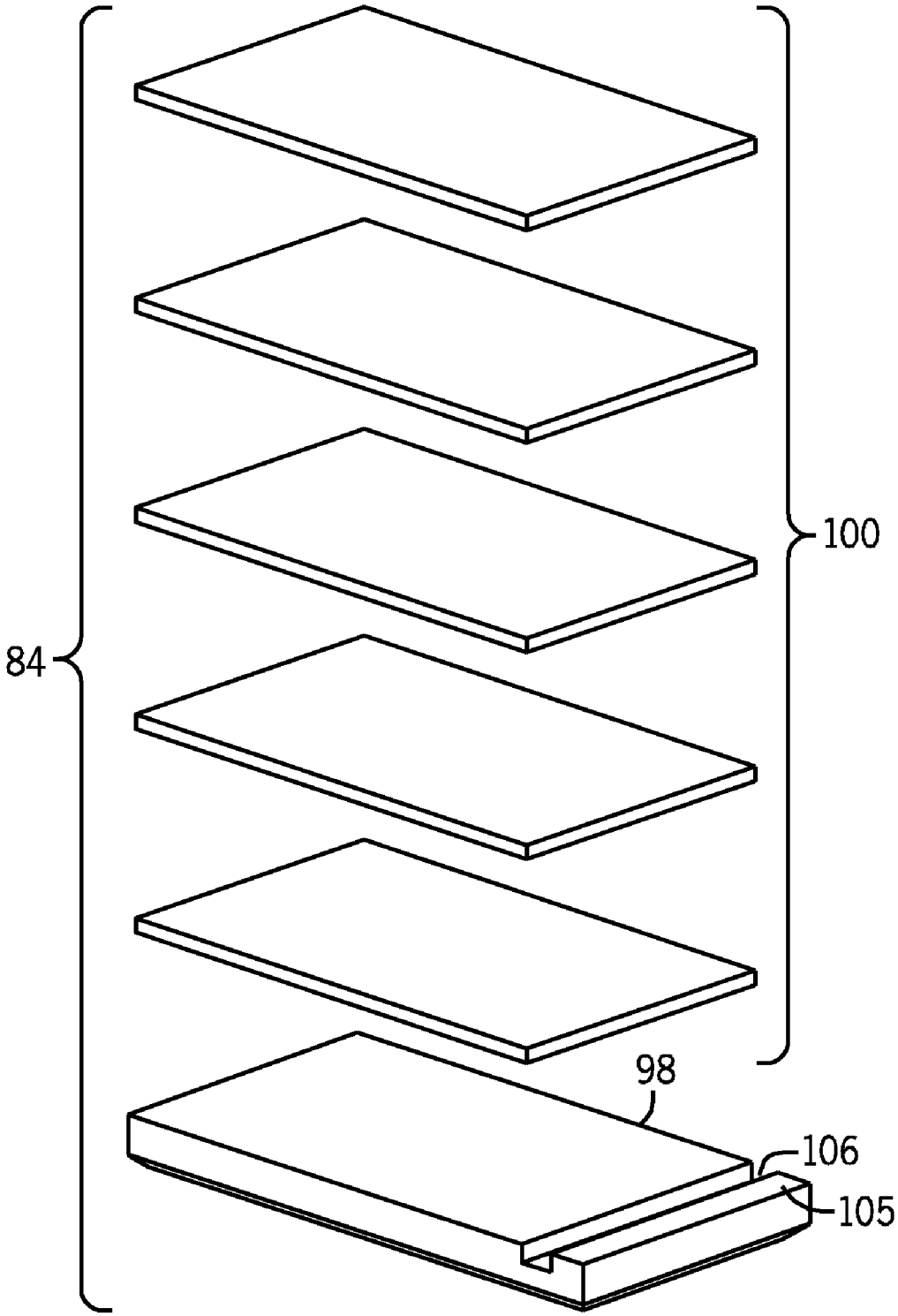

FIGS. 7 and 8 depict top and bottom exploded perspective view of the key pack 84 in accordance with an embodiment of present invention. FIG. 7 depicts a top exploded perspective view of the exploded key pack 84 in the desired vertical orientation, and FIG. 8 depicts a bottom exploded perspective view of the exploded key pack 84 in the opposite vertical orientation. As shown in FIGS. 7 and 8, the key pack 84 may include one or more segments 100 (e.g., shims) disposed vertically under the main key segment 98 (e.g., main key). A thickness of the key pack 84 is variable based on the selection of the segments. Again, an installation kit may include the key pack 84 with an excessive number and variety of segments (e.g., main key 98 and segments 100) to enable an installer to achieve the desired thickness quickly and easily without any machining. Thus, by varying of the thickness of the key pack 84 via selection of key segments, the alignment of the upper half turbine shell 78 and lower turbine shell 80 relative to the turbine rotary components may be adjusted without machining. In an embodiment, the main key 98 may define a minimum thickness of the key pack 84, and the segments 100 may be selectively used (or not used) to attain the desired thickness. The segments 100 may each have a thickness of at least less than approximately 5, 10, 15, 20, 25, 30, 35, 40, 45, 50 percent of the main key 98, or any combination thereof. For example, some or all of the segments 100 may have a thickness of between approximately 0.5 percent and 3 percent of the main key 98. The segments 100 may each have the same thickness or have different thicknesses from one another. In one embodiment, the main key 98 may be less than or equal to approximately 0.5, 1, 1.5, 2, 2.5, or 3 inch thick, and the segments may be less than or equal to approximately 5, 10, 15, 20, 25, 30, 35, 40, 45, 50, 100, 200, 300, or 500 mils thick. In one embodiment, the main key 98 may be approximately 0.5 to 1.5 inch thick and the segments 100 may be approximately 0 to 500, 5 to 300, or 10 to 100 mils thick. However, the number and dimensions of the main key 98 and segments 100 may vary by application.

Further, the key pack 84 defines a thickness of the support block 82 (e.g., first support of support assembly 70) solely without any machining. Thus, in an embodiment, neither the arm 86 (e.g., second support of support assembly 70) of the upper half turbine shell 78 nor the support block 82 is machined or otherwise physically altered to achieve the desired thickness. The thickness of the support block 82 is solely defined by the selection of the segments 100 included in the key pack 84. Advantageously, use of the key pack 84 may enable faster assembly and startup of a turbine 22 and corresponding power generation system 10.

The main key 98 may consist essentially of stellite, steel, or other suitable material capable of supporting the weight of the upper half turbine shell 78. In one embodiment, the main key 98 may be capable of supporting a weight of at least greater than approximately 50,000 pounds.

Figure 9:
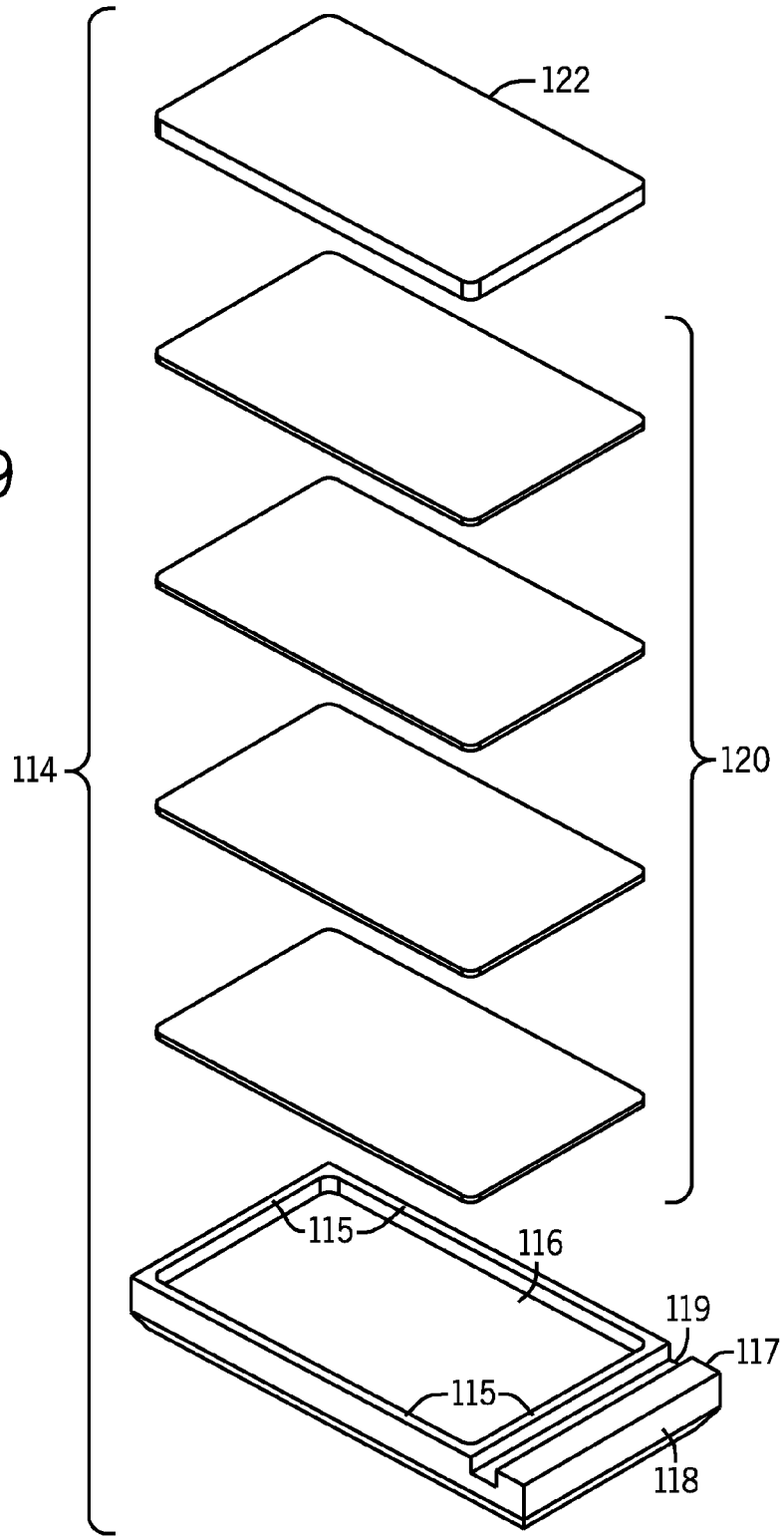
FIG. 9 depicts a close-up exploded view of a key pack having a key pocket in accordance with another embodiment of the present invention.

FIG. 9 depicts a key pack 114 having protruding frame 115 disposed about a key pocket 116 in accordance with an alternate embodiment of the present invention. In the embodiment shown in FIG. 9, a main key segment 118 (e.g., main key) may include the key pocket 116 configured to partially retain one or more segments 120 (e.g., shims). The pocket 116 may have the same general size and dimensions (width and length) as the segments 120. The pocket 116 also may have any depth suitable for aiding retention of the segments 120. The key pocket 116 may also include a protrusion 117 and/or a slot 119 to retain the key pack 114 to the support block 82, as discussed above. In such an embodiment, a "base" segment 122 (e.g., base shim) may also be included in the key pack 114. The base segment 122 may be made from the same material as the key 118 and may be placed on the bottom of the key pack 114 to provide additional spacing for the key pocket 116. In some embodiments, the key 118 and the base segment 122 may be formed from stellite, steel, or other suitable materials. In such an embodiment, the key pack 114 maybe used in a similar manner as the embodiments described above to define a thickness for the support block 82.

Figure 10:
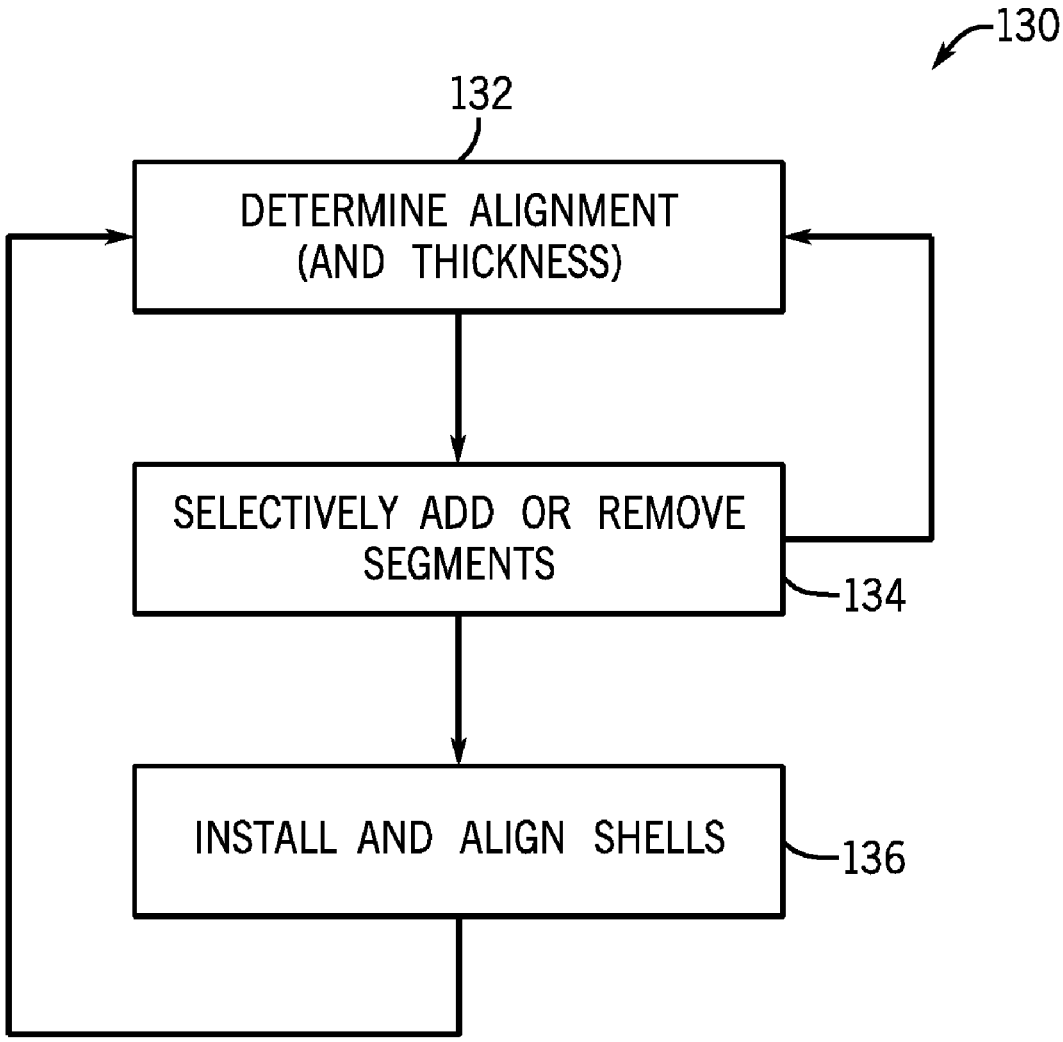
FIG. 10 depicts a process for defining a thickness by selectively stacking one or more segments in a key pack in accordance with an embodiment of the present invention.

FIG. 10 is a flowchart depicting a process 130 for defining a thickness by selectively stacking one or more segments 100 (e.g., shims) in the key pack 84 in accordance with an embodiment of the present invention. Initially, when assembling the stages 26, 28, and 30 of a turbine 22, the appropriate alignment of the upper half turbine shell 78 and the lower half turbine shell 80 relative to the turbine rotary components may be determined (block 132), such as by determining an appropriate thickness between the arm 86 of the upper half turbine shell 78 and the support block 82, as discussed above. Such alignment may define the cavity 90 for enclosure of the rotary components of the turbine 22. After determination of the alignment (and thickness) for alignment of the shells 78 and 80, segments 100 may be selectively added or removed (i.e., stacked) to the key pack 84, in combination with main key 98, to define a thickness between the support block 82 and the arm 86 (block 134). In some embodiments the selection may be an iterative process, such that each modification of the key pack 84 results in a new determination of alignment (and thickness) (block 132).

After assembly and installation of the key pack 84 to define the desired thickness, the upper half turbine shell 78 may be installed and bolted to the lower half turbine shell 80 (block 136). The thickness defined by the key pack 84 between the arm 86 and the upper half turbine shell 78 aligns the turbine shell halves 78 and 80 with the turbine rotary components. Again, the key pack 84 enables quick and easy alignment without any machining during installation. In some embodiments, after installation and alignment of the shells 78 and 80 the alignment (and thickness) may be redetermined (block 132)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbine engine comprising an exterior shell disposed about internal rotary components;

a pedestal configured to support the turbine engine, wherein a first support is coupled to the pedestal and a second support is coupled to the exterior shell, and the first and second supports are located outside of the exterior shell; and an alignment key pack configured to mount between the first and second supports, wherein the key pack comprises a plurality of key segments selectively arranged one over another to define a thickness to adjust a position of the exterior shell relative to the pedestal for alignment of the exterior shell with the internal rotary components.

2. The system of claim 1, wherein the alignment key pack comprises a main key segment and a plurality of shim segments, the main key segment has a main key thickness that is insufficient to adjust the position of the exterior shell for alignment with the internal rotary components, and at least one of the plurality of shim segments is stacked with the main key segment to provide the thickness sufficient to adjust the position of the exterior shell for alignment with the internal rotary components.

3. The system of claim 1, wherein the turbine engine comprises a first turbine stage and a second turbine stage, the pedestal is disposed between the first and second turbine stages, and the thickness of the alignment key pack is variable based on a selection of the key segments to adjust to adjust the position of the exterior shell of the first turbine stage or the second turbine stage for alignment with the internal rotary components of the first turbine stage or the second turbine stage.

4. The system of claim 1, wherein the first support comprises a support block extending from a lower portion of the pedestal, the second support comprises an arm extending from the exterior shell of the turbine engine, and the alignment key pack is disposed vertically between the support block and the arm.

5. The system of claim 2, wherein each of the plurality of shim segments has a shim thickness of at least less than approximately 5 percent of the main key thickness of the main key segment.

6. The system of claim 2, wherein the first support comprises a support block having a recess disposed between opposite tabs, one or more shim segments of the plurality of shim segments are disposed in the recess between the opposite tabs, the main key segment extends over the one or more shim segments, and a lockable plate locks the main key segment to the first support.

7. The system of claim 1, wherein the key segments have different thicknesses from one another, and each of the key segments comprises a metal plate.

8. The system of claim 1, wherein the alignment key pack is configured to provide the thickness to adjust the position of the exterior shell in a vertical direction for alignment with the internal rotary components via selective stacking of the key segments without any machining.

9. The system of claim 1, wherein the turbine engine comprises a steam turbine engine.

10. A system, comprising:

a turbine support key, comprising a set of key segments selectively stackable together in a plurality of combinations to adjust a thickness between turbine supports to adjust a position of an exterior turbine shell relative to a pedestal for alignment of the exterior turbine shell with internal rotary turbine components based solely on a selection of the key segments from the set.

11. The system of claim 10, wherein the wherein the set of key segments comprises a main key segment having a main key thickness that is insufficient to adjust the position of the exterior turbine shell for alignment with the internal rotary turbine components, and the set of key segments comprises at least one shim segment that is stackable with the main key segment to provide the thickness sufficient to adjust the position of the exterior turbine shell for alignment with the internal rotary turbine components.

12. The system of claim 10, comprising at least one of the turbine supports having a recess between opposite tabs configured to receive the turbine support key.

13. The system of claim 10, wherein the key segments comprise a plurality of shim segments disposed in a pocket of a main key segment, wherein a perimeter of the pocket surrounds an outer perimeter of the shim segments.

14. The system of claim 10, wherein the turbine support key is configured to support at least approximately 50,000 pounds, and the turbine support key comprises stellite.

15. The system of claim 10, wherein the key segments comprises a main key segment and a plurality of shim segments, the main key segment is less than or equal to approximately 1 inch thick, and the shim segments are less than or equal to approximately 20 mils thick.

16. The system of claim 10, wherein the key segments have different thicknesses from one another, and each of the key segments comprises a metal plate.

17. The system of claim 10, comprising the exterior turbine shell, wherein the thickness adjusts the position of an upper half of the exterior turbine shell and a lower half of the exterior turbine shell relative to the pedestal for alignment of the upper and lower halves of the exterior turbine shell with the internal rotary turbine components, and the upper and lower halves of the exterior shell remain in a fixed orientation relative to one another while the thickness adjusts the position.

18. The system of claim 17, comprising a steam turbine having the exterior turbine shell, the internal rotary turbine components, the turbine supports, and the turbine support key.

19. The system of claim 17, wherein the turbine supports comprise an arm of the upper half of the exterior turbine shell and a support block of the pedestal.

20. A system, comprising:

a turbine pedestal having a first turbine support configured to support a second turbine support coupled to an exterior shell disposed about internal rotary components of a turbine; and a key pack having two or more key segments selectively stacked into a key stack to define a thickness to adjust a position of the exterior shell relative to the turbine pedestal for alignment of the exterior shell with the internal rotary components.

21. The system of claim 20, wherein the key pack comprises a main key segment and a plurality of shim segments, the main key segment has a main key thickness that is insufficient to adjust the position of the exterior shell for alignment with the internal rotary components, and at least one of the plurality of shim segments is stacked with the main key segment to provide the thickness sufficient to adjust the position of the exterior shell for alignment with the internal rotary components.

* * * * *